US011426316B2

(12) United States Patent
Davis

(10) Patent No.: US 11,426,316 B2
(45) Date of Patent: Aug. 30, 2022

(54) CUSHION FOR USE AFTER A BREAST OPERATION

(71) Applicant: Claudia Davis, Cologne (DE)

(72) Inventor: Claudia Davis, Cologne (DE)

( * ) Notice: Subject to any disclaimer, the term of this patent is extended or adjusted under 35 U.S.C. 154(b) by 182 days.

(21) Appl. No.: 16/761,710

(22) PCT Filed: Nov. 5, 2018

(86) PCT No.: PCT/EP2018/080110
§ 371 (c)(1),
(2) Date: May 5, 2020

(87) PCT Pub. No.: WO2019/091894
PCT Pub. Date: May 16, 2019

(65) Prior Publication Data

US 2021/0177681 A1 Jun. 17, 2021

(30) Foreign Application Priority Data

Nov. 7, 2017 (DE) ..... 10 2017 125 933.3
Jun. 8, 2018 (DE) ..... 10 2018 113 789.3
Sep. 4, 2018 (DE) ..... 10 2018 121 591.6

(51) Int. Cl.
*A61G 7/07* (2006.01)
*A47G 9/10* (2006.01)
(Continued)

(52) U.S. Cl.
CPC ..... *A61G 7/07* (2013.01); *A47C 20/026* (2013.01); *A47G 9/1054* (2013.01); *A61G 7/057* (2013.01);
(Continued)

(58) Field of Classification Search
CPC .. A61G 7/05723; A61G 7/07; A61G 2200/12; A61G 2200/325; A61G 2200/54;
(Continued)

(56) References Cited

U.S. PATENT DOCUMENTS 2,835,905 A * 5/1958 Tomasson ..... A47G 9/10 5/636
2,940,088 A * 6/1960 Boos ..... A47G 9/10 5/636
(Continued)

FOREIGN PATENT DOCUMENTS

CA 2324818 A1 5/2002
CH 681592 A5 1/1992
(Continued)

OTHER PUBLICATIONS

International Preliminary Report on Patentability for Application No. PCT/EP2018/080110, filed Nov. 5, 2018 and titled, "Cushion for Use After a Breast Operation" dated May 12, 2020.
(Continued)

*Primary Examiner* — Robert G Santos
(74) *Attorney, Agent, or Firm* — Hamilton, Brook, Smith & Reynolds, P.C.

(57) ABSTRACT

The invention relates to a cushion for use when lying in a prone position after breast surgery, the cushion (10) having a base body (12) with a recess (14). The underlying object of the present invention is to provide a cushion which can be used after breast surgery for lying or sleeping in a prone position and which also offers a high degree of lying comfort and protection for the operated breast.
For this purpose, the base body (12) is formed of two layers and has a first harder layer (36) of foamed plastic and a second softer layer (38) of a viscoelastic material.

12 Claims, 3 Drawing Sheets

Figure 1:
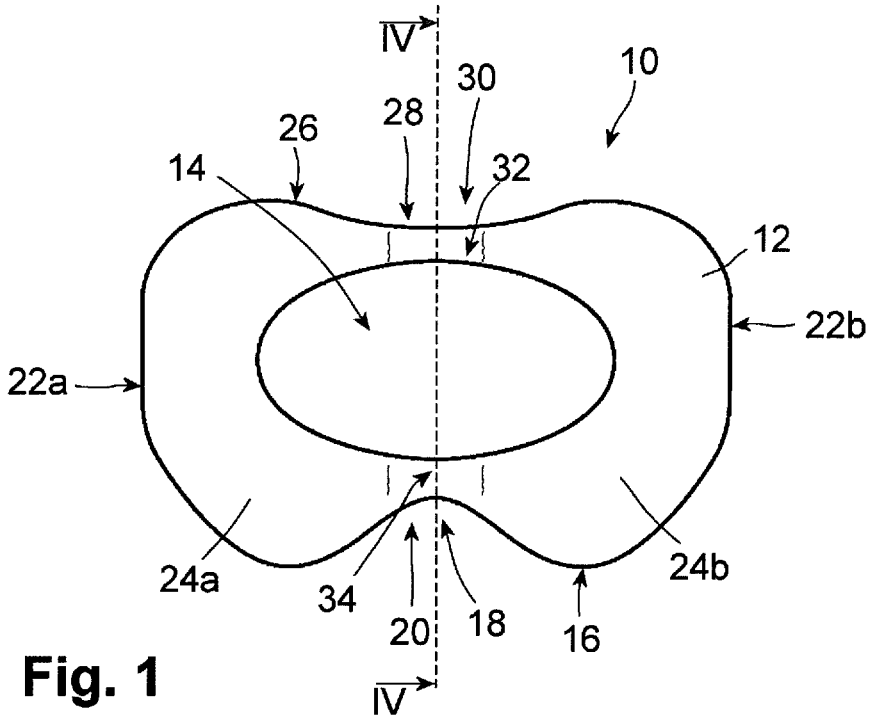

(51) Int. Cl.
*A47C 20/02* (2006.01)
*A61G 7/057* (2006.01)

(52) U.S. Cl.
CPC ..... *A61G 7/05723* (2013.01); *A61G 2200/12* (2013.01); *A61G 2200/325* (2013.01); *A61G 2200/54* (2013.01)

(58) Field of Classification Search
CPC .... A47C 20/025; A47C 20/026; A47G 9/1054
USPC ..... 5/631, 735, 930
See application file for complete search history.

(56) References Cited

U.S. PATENT DOCUMENTS

| | | | | | |
|---|---|---|---|---|---|
| 3,967,335 | A | 7/1976 | Rhoads | | |
| 5,018,231 | A * | 5/1991 | Wang | A47G 9/10 | 5/636 |
| 5,522,103 | A | 6/1996 | Kier et al. | | |
| 5,758,375 | A * | 6/1998 | Horowitz | A47G 9/10 | 5/640 |
| 6,052,847 | A * | 4/2000 | Allyn | A47C 20/026 | 5/632 |
| 6,154,903 | A | 12/2000 | Wai-Chung | | |
| 6,345,401 | B1 | 2/2002 | Frydman | | |
| 7,316,041 | B2 * | 1/2008 | Guez | A47G 9/10 | 5/636 |
| 7,426,762 | B2 * | 9/2008 | Dazzi | A47C 20/026 | 5/632 |
| 7,516,504 | B2 * | 4/2009 | Guez | A47G 9/10 | 5/636 |
| D634,960 | S * | 3/2011 | Anson | D6/601 | |
| 8,161,588 | B1 * | 4/2012 | Anson | A47G 9/109 | 5/636 |
| 8,261,384 | B2 * | 9/2012 | Batiste | A47C 7/425 | 5/634 |
| 8,555,437 | B2 * | 10/2013 | Gorovitz | A61G 13/121 | 5/613 |
| 8,584,280 | B2 * | 11/2013 | Shah | A61G 13/121 | 5/603 |
| 8,832,879 | B2 * | 9/2014 | Rubio | A47C 20/026 | 5/652 |
| D728,272 | S * | 5/2015 | Zimmerman | D6/601 | |
| 9,433,309 | B2 * | 9/2016 | Cheng | A47G 9/1054 | |
| D898,429 | S * | 10/2020 | Huang | D6/601 | |
| 11,278,136 | B2 * | 3/2022 | Murphy | A47G 9/1054 | |
| 2003/0211584 | A1 | 11/2003 | Milburn et al. | | |
| 2004/0029484 | A1 * | 2/2004 | Smith | A61F 5/03 | 450/1 |
| 2007/0006382 | A1 * | 1/2007 | Guez | A47G 9/10 | 5/636 |
| 2007/0089240 | A1 * | 4/2007 | Dazzi | A47G 9/1054 | 5/630 |
| 2008/0092296 | A1 * | 4/2008 | Guez | A47G 9/10 | 5/636 |
| 2008/0163427 | A1 * | 7/2008 | Howe | A47C 20/023 | 5/634 |
| 2008/0307580 | A1 | 12/2008 | Spitzer | | |
| 2009/0211584 | A1 | 8/2009 | Savich | | |
| 2010/0011508 | A1 * | 1/2010 | Rubio | A47C 20/026 | 5/632 |
| 2010/0122414 | A1 | 5/2010 | Shah | | |
| 2011/0010863 | A1 * | 1/2011 | Rubio | A47C 20/026 | 5/652 |
| 2011/0047705 | A1 * | 3/2011 | Gorovitz | A61G 13/121 | 5/613 |
| 2012/0023663 | A1 * | 2/2012 | Batiste | A47C 7/425 | 5/421 |
| 2012/0066837 | A1 * | 3/2012 | Thorsen | A47G 9/10 | 5/657 |
| 2013/0036555 | A1 * | 2/2013 | Weilert | A47C 20/026 | 5/632 |
| 2013/0098364 | A1 * | 4/2013 | Davis | A61G 7/072 | 128/206.21 |
| 2015/0040322 | A1 * | 2/2015 | Cheng | A47G 9/109 | 5/636 |
| 2020/0268183 | A1 * | 8/2020 | Murphy | A47G 9/109 | |
| 2021/0177681 | A1 * | 6/2021 | Davis | A61G 7/07 | |

FOREIGN PATENT DOCUMENTS

| | | | |
|---|---|---|---|
| DE | 1850147 | | 4/1962 |
| DE | 3934779 | A1 | 4/1991 |
| DE | 9113926.0 | U1 | 1/1992 |
| DE | 4306001 | A1 | 9/1993 |
| DE | 29919889 | U1 | 3/2000 |
| DE | 20012980 | U1 | 1/2001 |
| DE | 20209274 | U1 | 9/2002 |
| DE | 10157305 | A1 | 5/2003 |
| DE | 60311012 | T2 | 10/2004 |
| DE | 102006010298 | A1 | 9/2007 |
| DE | 102009004604 | A1 | 7/2010 |
| DE | 102010034872 | A1 | 3/2011 |
| DE | 202011110015 | U1 | 1/2013 |
| DE | 202015100958 | U1 | 5/2015 |
| EP | 1605802 | B1 | 1/2007 |
| EP | 2243455 | A1 | 10/2010 |
| EP | 2420216 | A2 | 8/2011 |
| WO | 8704606 | | 8/1987 |
| WO | 9524848 | | 9/1995 |
| WO | 2012048305 | A2 | 4/2012 |

OTHER PUBLICATIONS

International Search Report Int. Application No. PCT/EP2018/080110, filed Nov. 5, 2018 and titled, "Cushion for Use After a Breast Operation" dated Feb. 20, 2019.

* cited by examiner

CUSHION FOR USE AFTER A BREAST OPERATION

This application is the U.S. National Stage of International Application No. PCT/EP2018/080110, filed on Nov. 5, 2018, which designates the U.S., published in German, and claims priority under 35 U.S.C. § 119 or 365(c) to German Application No. 102017125933.3, filed Nov. 7, 2017, German Application No. 102018113789.3, filed Jun. 8, 2018, and German Application No. 102018121591.6, filed Sep. 4, 2018. The entire teachings of the above applications are incorporated herein by reference.

The invention relates to a cushion for use when lying or sleeping in a prone position after breast surgery. The cushion comprises a base body with a recess.

After breast surgery, the breast having undergone surgery usually has to be specially protected against forces to prevent any sutures closing surgical wounds from coming loose or the wound itself from healing poorly. Hence, patients are usually advised to lie and sleep in supine position for eight to twelve weeks after the surgery to avoid contact of the breast having undergone surgery and a mattress or an underlay.

From EP 2 420 216 A2 a device for the therapeutic treatment and care of the female breasts with a cushion is known. The cushion is designed for use in a prone position. The cushion is formed by a body triangular in longitudinal cross section and has a rounded ridge and wedge-shaped parts sloping to both sides. In the area of the ridge, a recess is formed to accommodate the breast. The cushion can be made of several components made of different materials.

Publication DE 101 57 305 A1 describes a support cushion, especially for the thorax or pelvic area when patients are positioned on their stomachs. The cushion has a core with a height of 10 to 35 cm made of an elastic material and at least one layer of viscoelastic foam with a thickness of 3 to 7 cm. For the guidance of a tube in the neck area of the patient, a frontal, open-edge recess with a depth in the range of 3 to 7 cm is suggested. Publication DE 603 11 012 T2 describes a cushion adapted to the female body shape with a cushion main body having a central opening surrounding the breast and an elongated cushion secondary body arranged transversely to the opening and positioned between the breasts at the sternum. The cushion consists of a ring-shaped core surrounded by a cushion filling, which is placed in a cotton cover. Publication DE 10 2006 010 298 A1 describes a cushion consisting of a non-equilateral part filled with foam, air, water or gel, with a sufficiently large opening for the female breast at its apex. Further cushions with recesses can be found in publications US 2008/0 307 580 A1, DE 202 09 274 U1 and DE 10 2009 004 604 A1.

Object of the present invention is to provide a cushion, which can be used after a breast surgery for lying or sleeping in a prone position and which also offers a high degree of lying comfort and protection for the operated breast.

To solve this object, a cushion comprising a base body with a recess is proposed, wherein the base body is formed of two layers and comprises a first harder layer of foamed plastic and a second softer layer of a viscoelastic material.

The base body of the cushion serves as a support of the patient's body and especially the torso, with the patient's breasts being accommodated within the recess. In particular, the base body has a closed shape and encloses the recess over its entire circumference. This provides the cushion with a particularly good stability.

The first harder layer of foamed plastic provides a basic rigidity of the base body. When charging the cushion with a load while lying on it, the first harder layer of foamed plastic will only yield slightly and will be compressed a little. The height of the first harder layer is designed sufficiently, so high that the cushion always has a sufficient height, even under the weight load from the patient's torso, which guarantees that no unacceptably high pressure is exerted on the operated breast. Preferably, the breast does not come into contact with an underlay placed underneath the cushion. The so-called solid height, which the first layer exhibits under compression due to weight load, is selected for a patient at least sufficiently high to ensure that the operated breast is accommodated in the recess free of contact with the underlay. The foamed plastic can be an open-pored plastic in particular.

For a pleasant feeling when lying down, a cushion made purely of foamed plastic has proven to be comparatively hard and uncomfortable. In order to increase lying comfort, the cushion according to the present invention features a second softer layer of viscoelastic material. The viscoelastic material is more easily compressed under load than the first harder layer of foamed plastic and, compared to the first harder layer, is compressed further or more intensely in relation to its original height under load. The layer of viscoelastic material has the property to return to its original position and height after exposure to a load. Hence, after exposure to a load, the cushion extends back to its original shape. Viscoelastic material is known for the production of mattresses. It is also called "memory foam" and is a shape memory polymer based on polyurethane, which is particularly known under the registered trademark Tempur.

The height of the first harder layer and/or the height of the second softer layer can be adjusted individually according to the patient's weight, on the one hand to ensure that the height is sufficient to support the body without the breast touching the underlay and on the other hand to provide a pleasant lying comfort.

In practice, the cushion is used so that the first harder layer is positioned towards the underlay, i.e. at the bottom, and the second softer layer is in contact with the patient. The cushion according to the invention enables patients to lie and sleep comfortably in the prone position after breast surgery.

In particular, the first harder layer and the second softer layer are glued together. Alternatively or in addition, the first layer and the second layer are sewn together.

In practice, the height of the base body decreases continuously in the longitudinal direction towards an end an abdominal end. For example, the height of the base body can decrease linearly, i.e. the base body is wedge-shaped in the direction of the abdominal end. In practice, the height of the base body can decrease from the edge of the recess positioned towards the abdominal end to the abdominal end. The abdominal end of the cushion is understood to be that part of the cushion which, when the cushion is used as intended, is positioned towards the patient's abdomen.

The length of the wedge-shaped contour may vary depending on the patient and especially on the time that has already passed since the breast surgery.

In a practical embodiment, the outer contour of the base body may have a concave, arcuate shape in plan view at the abdominal end to form an accommodation for the abdomen in order to further increase the patient's lying comfort. The arcuate shape extends in such a way that the length of the cushion at the abdominal end decreases from the lateral edges of the cushion towards the center. This results in an indentation at the abdominal end. Due to the curved shape, a lateral wing section is formed towards each of the lateral edges, the patient's abdomen being accommodated in the indentation between the two lateral wing sections. The patient is mainly supported laterally by the two wing sections and the abdomen is relieved. Due to the arcuate shape, the cushion is particularly ergonomic and uncomfortable pressure on the patient's abdomen is avoided.

In another practical embodiment, the outer contour of the base body may have a concave, arcuate shape in plan view at its head end to form an accommodation for a pillow or to form an accommodation for the neck. The head end of the base body or the cushion is the end, which is oriented towards the patient's head during use of the cushion.

Due to the different transverse extension of the neck compared to the abdomen, it is advisable to design the indentation for forming the neck accommodation smaller than the indentation for forming the abdominal accommodation.

As an additional measure to avoid excessive pressure on the neck and/or abdomen, the height of the main body, or at least the height of the first harder layer, at least in the area of the abdominal end may be lower in a central area than at the lateral edges. In other words, at least at the abdominal end, the harder layer of the base body surrounding the recess is higher at the sides than in the longitudinal center of the base body. This causes the solar plexus to be significantly relieved and the patient's weight to rest mainly via the lateral rib arches on the cushion. Also in the area of the neck at the head end of the main body, the height of the first harder layer may be reduced so that the patient's weight does not rest on the cushion via the neck but via the shoulders. The sensitive parts of the body are thus not or only slightly charged. The cushion has a particularly ergonomic design. Reducing only the height of the harder layer in the center means that the cushion can be manufactured with a uniform height and can be easily fitted with a cover of a uniform height. Weight relief is achieved by arranging only soft, compressible base body material in the central area. In practice, as described further below, the first harder layer may be completely left out in the center of the base body at the abdominal end, so that there, the base body consists only of the second softer layer. Alternatively, the entire base body may have a lower height in the center than at the sides, in particular in the area of the abdominal end of the base body and/or in the area of the head end of the base body.

The base body may have rounded edges in plan view. The width of the cushion in the transverse direction may be at least equal to the width of the patient's shoulders, and the length of the cushion may extend approximately from the lower rib arch to the patient's neck, so that the patient is supported on the cushion with the largest possible contact area of the upper body. The curvatures of the cushion prevent unpleasant sharp edges that can cause pressure marks on the arms when the patient grasps the cushion.

In practice, the recess may be oblong with rounded lateral sections or oval in plan view. An oblong recess with approximately semicircular ends or an oval recess, each with the long axis in the transverse direction, is particularly well adapted to the anatomy of a patient and surrounds the patient's breasts as accurately as possible. In this way, while providing optimum pressure relief of the breasts, the largest possible supporting area of the cushion distributing the pressure evenly is achieved.

For flexible adjustment of the cushion to the size of the patient, a pull means can be provided, by means of which the length of the base body from the head end to the abdominal end may be varied and fixed. Such a pull means may be e.g. a strap connected to the base body and extending between the head end and the abdominal end, the length of which may be varied. The strap forms an adjustable loop and may have a hook and loop fastener or other suitable device for adjusting and fixing the length of the loop. Alternatively, a strap may be attached to each side of the recess and connected to the opposite strap. Again, a hook and loop fastener with the two complementary parts arranged at the free ends of the straps may be used for the connection.

In practice, the cushion may have a cover, with the pull means attached to the cover. Hence, the pull means is accessible from the outside and the extension of the cushion in the longitudinal direction can be adapted and adjusted to the patient's needs as easily as possible without removing the cover. The external pull means can be washed together with the cover.

The ratio of the heights of the first layer and the second layer influences the compression of the cushion caused by the weight load and the resulting height. Sufficient height is particularly important to prevent the operated breast from coming into contact with the pad. The second, softer layer provides enhanced lying comfort. Tests have shown that an optimal lying sensation is achieved and at the same time the loaded cushion maintains sufficient height if the height of the first harder layer is at least twice the height of the second softer layer.

The invention also relates to the use of a cushion as described above as a support for the chest and shoulders of a patient resting in a prone position. With regard to the advantages, reference is made to the above description.

In practice, a pillow can be placed at the head end, on which the patient's head rests. The cushion according to the invention can therefore be used as a supplement to a conventional pillow.

Figure 2:
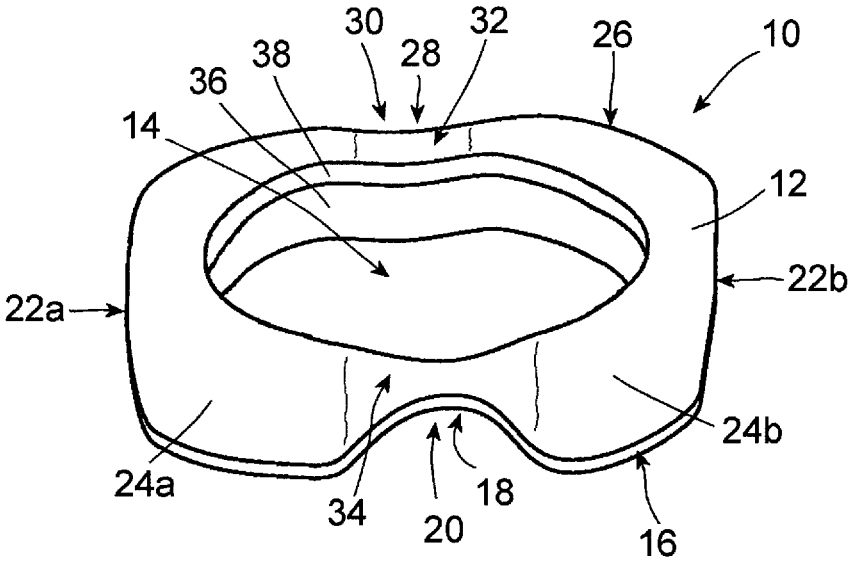
Figure 3:
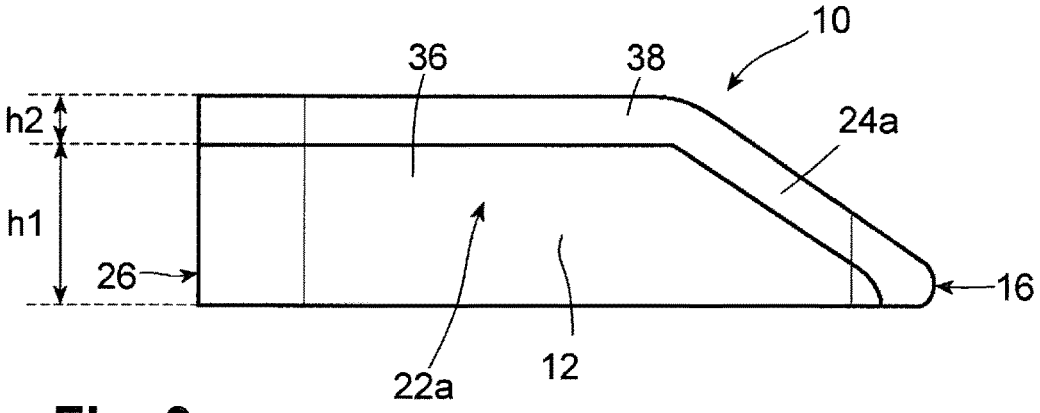
Figure 4:
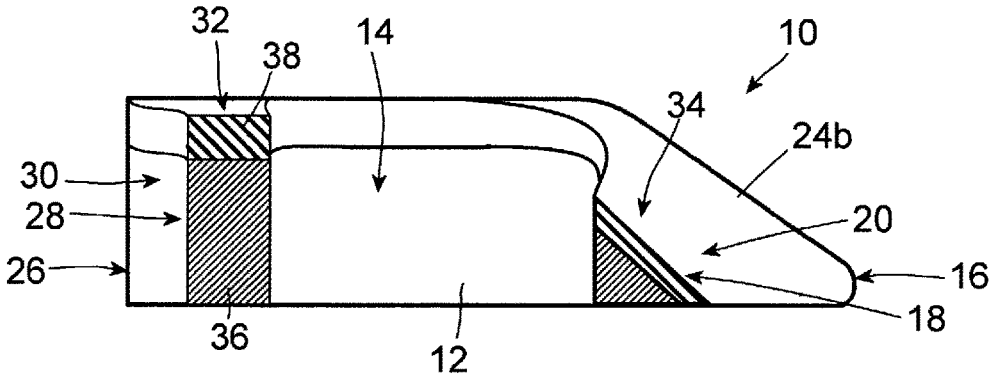
Figure 5:
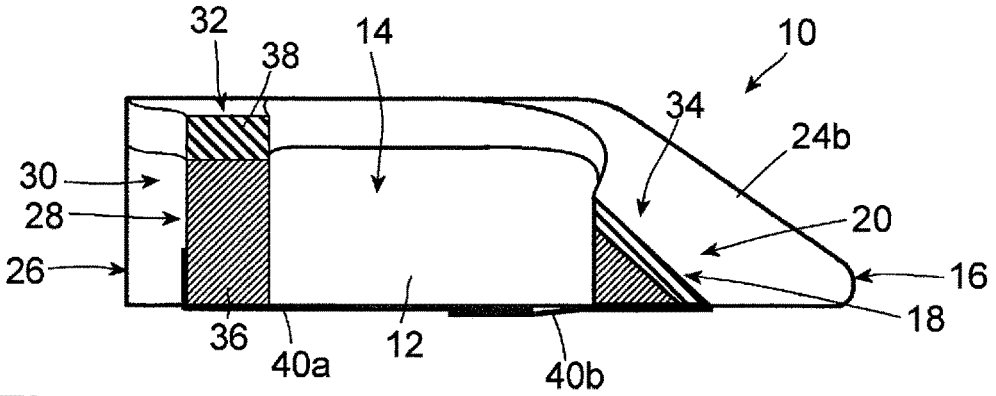
Figure 6:
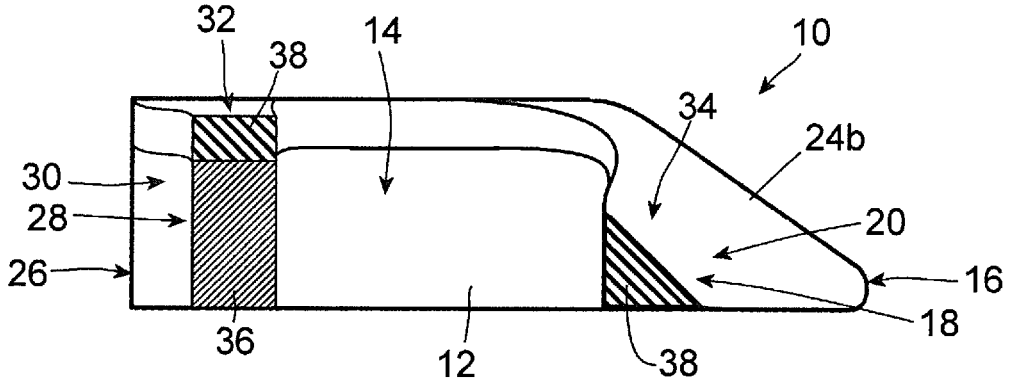
Figure 7:
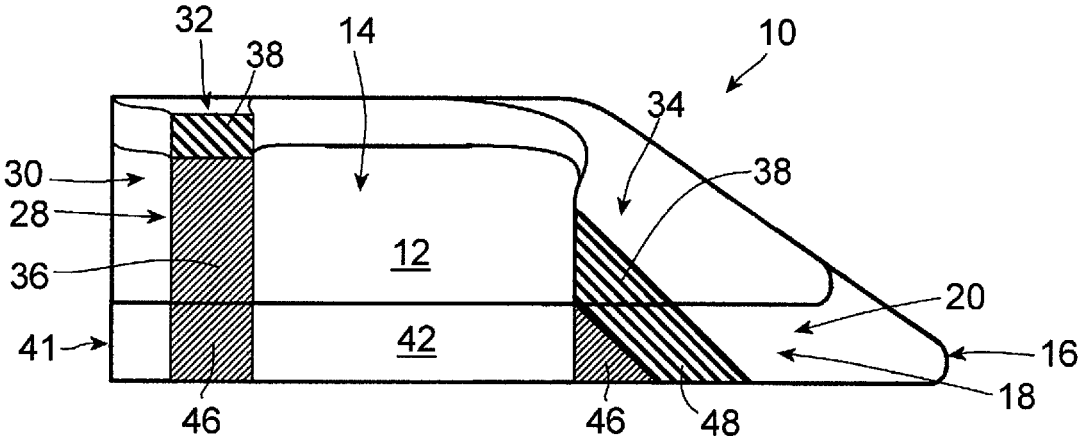

Further practical embodiments and advantages of the invention are described below in connection with the drawings. The figures show:

FIG. 1 a cushion according to the invention in a plan view,

FIG. 2 the cushion from FIG. 1 in a perspective view from diagonally above, FIG. 3 the cushion from FIGS. 1 and 2 in a side view, FIG. 4 the cushion from FIGS. 1 to 3 in a sectional view along section line IV-IV from FIG. 1, FIG. 5 a second version of a cushion in a sectional view analogous to FIG. 4, FIG. 6 a sectional view of a variant of the cushion corresponding to FIG. 4, in which the harder layer of the base body is interrupted in the area of the solar plexus, and FIG. 7 a sectional view of the variant corresponding to FIG. 6 with an additional cushion which increases the overall height of the cushion.

FIG. 1 shows a cushion 10 in plan view. The cushion 10 has a base body 12 with a recess 14, which is enclosed by the base body 12. The recess 14 is essentially oval. However, it can also be designed as an elongated hole with rounded lateral edges. The base body 12 has rounded edges in plan view to avoid sharp edges that can cause pressure marks.

Cushion 10 has an abdominal end 16 which, when the cushion 10 is used, points towards the patient's abdomen. The outer contour of the abdominal end 16 is concave in an arcuate shape so that an indentation 18 is formed in the center of the abdominal end, forming an accommodation for the abdomen 20. Starting from the lateral edges 22*a*, 22*b*, this creates two wing sections 24*a*, 24*b* which carry the patient's rib arches.

On the side of cushion 10 opposite the abdominal end 16, the cushion 10 has a head end 26. The outer contour of the head end 26 also has a concave, arcuate shape, so that an indentation 28 is formed from the lateral edges 22*a*, 22*b* towards the center in plan view. The indentation 28 forms an accommodation 30 for a conventional cushion on which the head rests.

As can be clearly seen in FIG. 2, the height at the edge of the recess 14 in the center is lower than at the lateral edges 22*a*, 22*b*, so that a trough-like depression 32 for the neck and a trough-like depression 34 for the solar plexus are formed in the center of the cushion 10. The neck and the solar plexus are thus relieved from uncomfortably high pressure. It is also possible to relieve only the solar plexus by means of a trough-like depression 34 at the abdominal end of the cushion 10. With this pressure relief the patient's weight is supported on the cushion via the lateral rib arches and/or shoulders. As an alternative to a depression of the entire base body 12, a depression only in the harder layer in the center may also be provided, as described below.

The transition from the head end 26 to the side edges 22*a*, 22*b* is rounded, thus allowing a patient to place her arms around the cushion 10 without worrying about pressure marks due to sharp corners or edges.

FIG. 2 to FIG. 4 show the two-part design of the base body 12. The base body 12 comprises a first harder layer 36 made of a foamed plastic and a second softer layer 38 made of a viscoelastic material. In this embodiment, the height h1 of the first layer 36 is about three times the height h2 of the second layer 38 (see FIG. 3). This makes the cushion 10 in this embodiment particularly stable.

As can also be clearly seen in the side view in FIG. 3 and in the longitudinal section in FIG. 4, the height of the base body 12 decreases linearly or wedge-shaped from the recess 14 towards the abdominal end 16. This results in a continuous and smooth transition from the edge of the recess 14 to the abdominal end 16 of the cushion 10. At the head end 26, the cushion 10 has a height, which must be compensated by a pillow on which the patient's head rests.

FIG. 5 shows a second embodiment of a cushion 10, the cushion 10 being essentially identical to the first embodiment shown in FIGS. 1 to 4. The second embodiment in FIG. 5 differs from the first embodiment in that a pull means 40*a*, 40*b* is provided on the base body 12. The pull means 40*a*, 40*b* is formed by a strap with a width of approx. 10 mm and consists of two parts. The first part 40*a* is attached, for example glued or sewn on, to the underside of the head end 26 in the area of the pillow accommodation 30. It extends towards the abdominal end 16 into the recess 14. The second part 40*b* of the pull means is attached to the underside of the abdominal end 16 and extends towards the head end 26 into the recess 14. The parts 40*a*, 40*b* of the pull means therefore run underneath the cushion 10 and overlap in the area of the recess 14. The parts 40*a*, 40*b* of the pull means are provided with the loop part and the hook part of a hook and loop fastener on the surfaces facing each other, so that the pull means 40*a*, 40*b* is designed to be adjustable in length in order to enable the change of the extension of the cushion 10 in the longitudinal direction. The pull means can also be provided with other means for length adjustment, e.g. with a buckle through which the strap is passed. Alternatively, the two parts of the pull means may be formed by soft fabric straps, which are knotted together or connected by a loop.

FIG. 7 shows another embodiment of cushion 10, in which the first hard layer 36 of the base body 12 is interrupted towards the abdominal end 16 of cushion 10. In other words, the cushion 10 does not have a first hard layer 36 of the base body 12 in the center between the two lateral edges 22*a*, 22*b* over a distance of approx. 30 to 60 mm and consists only of the second softer layer 38. This facilitates the production of the first harder layer 36 of the base body 12. By interrupting the first harder layer 36 of the base body 12 at the abdominal end of the cushion 10, it is easier to prepare bevels at the first harder layer 36 of the base body within the recess 14 with a knife or a sawing device. In addition, the pressure release of the solar plexus is considerably increased. Some patients find the pressure caused by the harder material of the base body 12 in the area of the solar plexus unpleasant. The absence of the harder layer 36 in the center of the cushion avoids unpleasant pressure.

The height of the cushion from FIGS. 4 to 6 is preferably in the range of 130 to 150 mm. This height has proven to be the optimum value for relieving the breast during healing, on the one hand for relieving pressure and on the other hand for a comfortable sleeping position.

In the first 10 days after breast surgery, the patient wears a compression bra and is particularly sensitive to pressure loads. During these days, the pressure relief provided by the 130 to 150 mm high cushion is usually not sufficient and the cushion should be designed about 80 mm higher. FIG. 7 shows such a cushion, obtained from cushion 10 of FIG. 6 with an 80 mm high elevation 41. The elevation 41 is composed of the base elevation 42, which consists of the harder material 46 of the harder layer 36, and the abdominal elevation, which consists of the softer material 48 of the softer layer 38. This high cushion provides considerable relief during the first days after surgery, but offers a less comfortable sleeping position.

The features of the invention disclosed in the present description, in the drawings as well as in the claims may be essential for the realization of the invention in its various embodiments, either individually or in any combination. The invention is not limited to the described embodiments. It may be varied within the scope of the claims taking into account the knowledge of a person skilled in the art.

LIST OF REFERENCE SIGNS

10 cushion
12 base body
14 recess
16 abdominal end
18 indentation
20 abdominal accommodation
22*a*, 22*b* lateral edge p 24*a*, 24*b* wing section
26 head end
28 indentation
30 pillow accommodation
32 depression (neck area)
34 depression (abdominal area)
36 first harder layer
38 second softer layer
40*a* first part of the pull means
40*b* second part of the pull means
41 elevation
42 base body elevation
46 harder material
48 softer material

The invention claimed is:

1. A cushion for use when lying in a prone position after breast surgery, the cushion comprising:

a base body with a recess, wherein the base body is formed of two-layers and comprises a first, harder layer of foamed plastic and a second, softer layer of a viscoelastic material, the base body including a head end and an abdominal end, wherein the base body has a closed shape and encloses the recess over its entire circumference, wherein the height of the base body decreases continuously in a longitudinal direction towards the abdominal end of the base body, and wherein at least in a region of the abdominal end the height of at least the first, harder layer of the base body is lower in a central region than at lateral edges of the cushion.

2. The cushion according to claim 1, wherein the outer contour of the base body has a concave, arcuate shape in plan view at the abdominal end to form an accommodation for the abdomen.

3. The cushion according to claim 1, wherein the outer contour of the base body has a concave, arcuate shape in plan view at the head end.

4. The cushion according to claim 1, wherein the first, harder layer of the base body is interrupted at the abdominal end in the center between the lateral edges of the cushion.

5. The cushion according to claim 1, wherein the height of the entire base body is lower in a central region than at the lateral edges of the cushion.

6. The cushion according to claim 1, wherein the base body has rounded edges in plan view.

7. The cushion according to claim 1, wherein the recess is oblong in plan view with rounded lateral sections or oval.

8. The cushion according to claim 1, wherein a pull means is provided by means of which the length of the base body from the head end to the abdominal end can be varied and fixed.

9. The cushion according to claim 1, wherein the height of the first harder layer is at least twice the height of the second, softer layer.

10. The cushion according to claim 1, wherein the cushion has an elevation portion, which increases the overall height of the cushion for a particularly high pressure relief.

11. A method for use of a cushion according to claim 1, the method comprising: using the cushion as a support for the chest and shoulders of a patient resting in a prone position.

12. The method according to claim 11, further comprising arranging a pillow on which a patient's head rests at the head end.

* * * * *